US005714455A

United States Patent [19]

Gutierrez et al.

[11] Patent Number: 5,714,455

[45] Date of Patent: Feb. 3, 1998

[54] INTIMATE ADMIXTURES OF SALTS OF SULFO CARBOXYMETHYLOXY SUCCINATE (SCOMS) WITH SELECTED GLYCOLIPID BASED SURFACTANTS TO IMPROVE THE FLOW AND HANDLING

[75] Inventors: Eddie Nelson Gutierrez, Midland Park; Shang-Ren Wu, Mahwah, both of N.J.

[73] Assignee: Lever Brothers Company, Division of Conopco, Inc., New York, N.Y.

[21] Appl. No.: 667,316

[22] Filed: Jun. 20, 1996

Related U.S. Application Data

[63] Continuation of Ser. No. 348,384, Dec. 2, 1994, abandoned.

[51] Int. Cl.[6] ..... C11D 3/32; C11D 3/34

[52] U.S. Cl. ..... 510/446; 510/470; 510/479; 510/501; 510/506; 510/496

[58] Field of Search ..... 510/479, 501, 510/470, 506, 446, 496

[56] References Cited

U.S. PATENT DOCUMENTS

| | | | |
|---|---|---|---|
| 3,128,287 | 4/1964 | Berg | 260/346.8 |
| 3,151,084 | 9/1964 | Schlitz et al. | 252/137 |
| 3,692,685 | 9/1972 | Lamberti et al. | 252/89 |
| 3,920,564 | 11/1975 | Grecsek | 252/8.75 |
| 3,925,375 | 12/1975 | Lamberti | 260/247.1 E |
| 3,957,775 | 5/1976 | Lamberti | 260/247.1 E |
| 4,397,776 | 8/1983 | Ward | 252/527 |
| 4,560,491 | 12/1985 | Sherman | 252/106 |
| 4,663,071 | 5/1987 | Bush et al. | 252/174.19 |
| 4,704,233 | 11/1987 | Hartman et al. | 252/527 |
| 5,068,420 | 11/1991 | Kreczmer | 562/583 |
| 5,104,568 | 4/1992 | Shaw, Jr. et al. | 252/174.18 |
| 5,254,281 | 10/1993 | Pichardo et al. | 252/108 |
| 5,296,588 | 3/1994 | Au et al. | 536/1.11 |
| 5,318,728 | 6/1994 | Surutzidis et al. | 252/548 |
| 5,332,528 | 7/1994 | Pan et al. | 252/548 |
| 5,336,765 | 8/1994 | Au et al. | 536/18.5 |
| 5,338,487 | 8/1994 | Connor et al. | 252/357 |
| 5,389,279 | 2/1995 | Au et al. | 252/108 |
| 5,395,543 | 3/1995 | Johansson et al. | 252/174.17 |
| 5,401,426 | 3/1995 | Gerling et al. | 252/8.6 |
| 5,488,146 | 1/1996 | Gutierrez | 562/109 |

OTHER PUBLICATIONS

"Surface Active Agents and Detergents", Schwartz, Perry & Berch, vols. I and II, (Interscience Publishers Inc., New York, 1958).

Co–pending application Serial No. 08/362,357.

Co–pending application Serial No. 08/362,358.

Defensive Publication No. T. 101,805, May 4, 1982.

*Primary Examiner*—Paul Lieberman

*Assistant Examiner*—John R. Hardee

*Attorney, Agent, or Firm*—James J. Farrell

[57] ABSTRACT

A process for improving the flowability of compositions containing SCMOS is disclosed which includes employing the salt of SCMOS in intimate admixture with a nonionic glycolipid surfactant as the major SCMOS containing constituent of the composition.

5 Claims, No Drawings

INTIMATE ADMIXTURES OF SALTS OF SULFO CARBOXYMETHYLOXY SUCCINATE (SCOMS) WITH SELECTED GLYCOLIPID BASED SURFACTANTS TO IMPROVE THE FLOW AND HANDLING

This is a continuation application of Ser. No. 08/348,384, filed Dec. 2, 1994, now abandoned.

BACKGROUND OF THE INVENTION

1. Field of the Invention

The invention relates to the preparation and use of intimate admixtures of saccharide or glycolipid surfactants with selected salts of SCMOS acid to improve the flow characteristics of the SCMOS salt, for use in detergent formulations. SCMOS salts, when used in detergent formulations, are effective sequestering agents and are thus useful as builders in household, institutional and industrial detergent compositions. Many of the salt forms are, however, highly hygroscopic and cake and become very difficult to handle.

Sulfo carboxymethyl succinate (SCMOS) is a builder disclosed in Example 10 of U.S. Pat. No. 3,957,775. It is produced by reacting sulfo maleic anhydride with an excess of glycolic acid esters. The log $K_{Ca}$ of tetrasodium Sulfo CMOS is 5.7. The compound is thus a good sequestrant builder.

2. Related Art

Preparation of SCMOS salts is well known and U.S. Pat. No. 3,957,775 to Lamberti et al. discloses a method of preparing SCMOS as well as compositions with which it may be used.

Copending patent application U.S. Ser. No. 08/362,357 to Gutierrez et al. (Docket No. 94-R178-EDG) now U.S. Pat. No. 5,488,146, discloses an improved method for obtaining SCMOS salts and U.S. Ser. No. 08/339,374 (Docket No. 93-R331-EDG) to Gutierrez et al., now abandoned, discloses a method for reducing the hygroscopicity of ODS salts by preparation of the monosodium salt.

U.S. Pat. No. 5,104,568 to Shaw et al. recognizes that selected ODS salts are hygroscopic and attempts to solve the problem by an aqueous zeolite/ODS coagglomeration process which is said to result in a non-hygroscopic formulation. The amount of zeolite is very high and adds excessive bulk to the formulation.

The use of intimate admixtures containing hygroscopic SCMOS salts and selected saccharide or glycolipid surfactants which improve the handling characteristics of SCMOS salts when used with detergent compositions is thus seen to be desirable.

Accordingly, it is an object of the present invention to provide an intimate admixture of selected saccharide or glycolipid surfactants with SCMOS salts to improve the handling characteristics of the SCMOS salt, for use in detergent compositions.

This and other objects and advantages will appear as the description proceeds.

SUMMARY OF THE INVENTION

The attainment of the above objects is made possible by this invention which includes the preparation of an intimate admixture of specified long chain alkyl, mono- or disaccharide glycolipid surfactants with an SCMOS salt to result in a free flowing powder and the use of this admixture in detergent compositions.

In general the glycolipid surfactant must be a stable solid and employ a narrow range alkyl group of $C_{8-18}$ where the average number of carbon atoms does not vary by more than 2 carbons, e.g., $C_{14-16}$ or $C_{10-12}$. In combination with a monosaccharide or a disaccharide, a broad range of alkyl such as "coco" is not as effective. The group linking the alkyl with the saccharide is not important to the functionality of the glycolipid in the instant invention. Suitable linkages are well known in the art and include amides, esters, glycosidic linkages, long chain acetates, alkylidine and the like. In fact it is likely that any hygroscopic builder will benefit from forming an intimiate admixture with such glycolipid surfactants.

It has been found that intimate admixtures of selected alkyl saccharide glycolipid surfactants with hygroscopic builders such as the salts of ODS allow easy handling of the SCMOS because the mixture remains substantially free flowing and powdery. This is so even though the SCMOS salts still absorb almost the same amount of water as if they were not mixed. This is a sufficient amount of water to render them unsuitable in the absence of the alkyl saccharide. The suitable mixtures contain about 1 part SCMOS salt to about 1.4 to 4 parts or even more alkyl saccharide surfactant, i.e., from about 1:1.4 parts SCMOS salt to alkyl saccharide to about 1:30 and preferably about 1:4 parts SCMOS to alkyl saccharide. The alkyl saccharides that are suitable as well as methods for their preparation are well known in the art and have been fully described in, for example, U.S. Pat. No. 5,296,588 and 5,336,765 incorporated herein by reference.

Suitable glycolipids include nonionic aldonamides including mono- and disaccharide derivatives such as aldobionamides. An aldobionamide is defined as the amide of an aldobionic acid (or aldobionolactone) and an aldobionic acid in turn is defined as a sugar substance (e.g., any cyclic sugar) in which the aldehyde group (generally found at the $C_1$ position on the sugar) has been replaced by carboxylic acid which upon drying cyclizes to an aldonolactone. Aldobionamides are based on compounds comprising two saccharide units, (e.g., lactobionamide or maltobionamide) or they may be based on compounds comprising more than two saccharide units as long as the polysaccharide has a terminal sugar unit with an aldehyde group available. Aldonamides on the other hand can be based on single saccharide units.

In Williams et al., Archives of Biochem. and Biophysics, 195(1):145–151 (1979), there are described glycolipids prepared by linking aldobionic acids to alkylamines through an amide bond.

In addition, the amide link can be reversed to form a polyhydroxy fatty acid amide such as is disclosed in U.S. Pat. No. 5,254,281, for example, alkyl N-methyl glucamides are also suitable in the intimate admixtures of the invention. Alkylpolyglycosides described in U.S. Pat. No. 4,663,069 and related cases are also suitable.

Disaccharide compounds such as lactobionamides or maltobionamides are suitable compounds. Other examples of aldobionamides (disaccharides) which may be used include cellobionamides, melibionamides and gentiobionamides.

A specific example of an aldobionamide which may be used for purposes of the invention is the disaccharide lactobionamide set forth below:

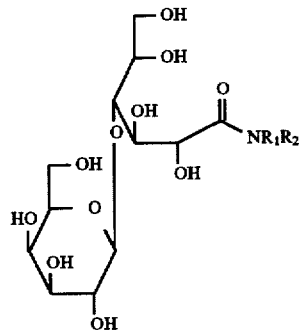

wherein $R_1$ and $R_2$ are the same or different and are selected from the group consisting of hydrogen; an aliphatic hydrocarbon radical (e.g., alkyl groups and monoalkene groups which groups have $C_{8-18}$ where the average number of carbon atoms does not vary by more than 2 carbon atoms except that $R_1$ and $R_2$ cannot be hydrogen at the same time.

Suitable aliphatic hydrocarbon radicals include saturated and mono-unsaturated radicals including but not limited to octyl, nonyl, decyl, undecyl, dodecyl, tridecyl, tetradecyl, pentadecyl, hexadecyl, heptadecyl, octadecyl, undecenyl, and oleyl.

The SCMOS compounds of the invention are salts of SCMOS acid.

SCMOS ACID FORMULA I

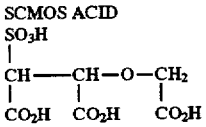

SCMOS acid (Formula I) or SCMOS salts may be prepared by methods known in the art. Such methods are disclosed, for example, in U.S. Pat. No. 3,957,775 to Lamberti et al. discussed above and incorporated herein by reference. The U.S. Pat. No. 3,957,775 patent also discloses detergent compositions which may employ SCMOS or salts thereof.

In general, the salts are prepared by a simple acid-base reaction between the SCMOS acid of Formula I and the desired aqueous solution of alkali metal hydroxide in the appropriate molar ratio. The reaction mixture is heated and agitated to effect reaction. The sample solutions are then either freeze dried overnight or evaporated to dryness on a roto evaporator under vacuum to obtain the appropriate salt, for example, the tetrasodium salt CAS No. 41344-35-8.

DETAILED DESCRIPTION OF THE INVENTION

This invention, which improves the flowability of normally hygroscopic SCMOS builder salts is an intimate admixture of (a) an SCMOS salt selected from the group consisting of tetraalkali metal, tri-alkali metal and di-alkali metal salts of SCMOS; and (b) a nonionic glycolipid selected from the group consisting of aldonamides and polyhydroxy fatty acid amides. Aldonamides include alkyl lactobionamides, alkyl maltobionamides, polyhydroxy fatty acid amides include alkyl N-methyl glucamides, and polyhydroxy fatty acid esters including alkyl glucoside fatty acid esters such as methyl glucoside monolaurate.

The admixture is incorporated into a detergent composition so that the major portion of the builder present in the detergent composition is the SCMOS salt from the admixture. A detergent composition containing the major portion of its SCMOS as the salt with improved flowability is also contemplated as is a method for improving the handling characteristics of SCMOS by intimately admixing it with selected glycolipids.

The selected SCMOS salt can be used as a builder in its water-soluble salt form in a wide variety of detergent or laundry additive compositions.

Detergent compositions incorporating the mixture of this invention contain as essential components from about 0.5% to about 98% of a surfactant and from about 2% to about 99.5% of the selected mixture which contributes as a detergency builder and as a surfactant. Additional non-glycolipid surfactants that are useful in the present invention are the anionic (soap and nonsoap), non-glycolipid nonionic, zwitterionic and ampholytic compounds. The chemical nature of these additional detergent compounds aside from their being non-glycolipid to distinguish them from the surfactants of the intimate admixture is not an essential feature of the present invention. Moreover, such detergent compounds are well known to those skilled in the detergent art and the patent and printed literature are replete with disclosures of such compounds. Typical of such literature is "Surface Active Agents" by Schwartz, Perry and Berch, the disclosure of which is incorporated by reference herein. The ODS builder can be used either as the sole builder or where desired can be used in conjunction with other well-known builders, examples of which include water-soluble salts of phosphates, pyrophosphates, orthophosphates, polyphosphates, phosphonates, carbonates, polyhydroxysulfonates, polyacetates, carboxylates, polycarboxylates, succinates, zeolites and the like.

In the detergent composition, in addition to the surfactant and builder there may be optionally present additional ingredients which enhance the performance of the detergent composition. Typical examples thereof include the well known soil suspending agents, hydrotropes, corrosion inhibitors, dyes, perfumes fillers, optical brighteners, enzymes, suds boosters, suds depressants, germicides, anti-tarnishing agents, cationic detergents, softeners, buffers and the like.

The detergent compositions of the present invention may be in any of the usual physical forms for such compositions, such as powders, beads, flakes, bars, tablets, noodles, liquids, pastes and the like, powders are, however, preferred. The detergent compositions are prepared and utilized in the conventional manner. The wash solutions thereof desirably have a pH from about 7 to about 12, preferably from about 9 to about 11. In this manner, alkalinity from sodium or other cations is available to convert the salts into a form which will readily sequester undesirable cations such as magnesium and calcium.

The following examples are designed to illustrate, but not to limit, the practice of the instant invention. All percentages and parts herein are by weight unless indicated otherwise. All ratios herein are weight ratios unless indicated otherwise.

EXAMPLE 1

Tetrasodium sulfo carboxymethyloxy succinate ($Na_4$ SCMOS) may be prepared as follows:

PREPARATION OF THE TETRASODIUM SALT OF SCMOS

Sulfomaleic anhydride (19.4 gm) is heated to 60° C. and combined with 76 gm of ethyl glycolate. After heating the mixture at 80° C. for 5½ hours, there is added a solution of 45 gm of sodium hydroxide dissolved in 135 gm of water and heating is continued at 80° C. for an additional 3 hours.

The mixture is then diluted with water and passed through a column of a cation exchange resin. The resulting eluent is then evaporated in vacuo to a low volume and the concentrate extracted repeatedly with acetone to remove glycolic acid and other impurities. The resulting extracted residue is then dissolved in water and the pH of the solution adjusted to 8.6 with dilute sodium hydroxide. Evaporation of the solution in vacuo and drying over $P_2O_5$ give a residue of the tetrasodium salt of SCMOS. This salt is in turn dry blended to form intimate admixtures in 50 ml crystallizing dishes, with either lauryl N-methyl glucamide, tetradecyl lactobionamide, cocobionamide or $C_{14}$ maltobionamide in a ratio of 1:2 builder:surfactant and stored at 25° C. 65% relative humidity (R.H.) for variable periods of time.

Glucose, sorbitol and mixtures of these carbohydrates with SCMOS prepared by a different method were also investigated to determine the effect of the hydrophilic sugar group without the alkyl chain. Table 1 shows the results of this study.

Samples of SCMOS (0.25 g) were either stored as is or mixed with sugar surfactant (0.50 g) or monosaccharide (0.50 g) in a 50 ml crystallizing dish of 50 cm×35 cm size at a relative humidity of 65% (saturated sodium nitrite solution) at 25° C. Samples were removed periodically, weighed and returned to the chamber. Percent water uptake was based on the amount of builder present:

% uptake=g of water absorbed/g of builder

When only the monosaccharides or just the sugar surfactants were present, the percent uptake was based on the saccharide, i.e., % uptake=g of water/g of saccharide

TABLE 1

| | NO. DAYS | % WATER | PROPERTY |
|---|---|---|---|
| $Na_4$ SCMOS | 9 | 38 | sticky |
| Tetradecyl Lactobionamide ($C_{14}$-LBM) | 8 | 0 | solid |
| $C_{14}$ Maltobionamide ($C_{14}$-MBM) | 4 | 10 | solid |
| Lauryl N-methyl Glucamide ($C_{12}$-NMG) | 8 | 0 | solid |
| Glucose (comparative) | 2 | 0 | solid |
| Sorbitol (comparative) | 2 | 1.4 | solid |
| $Na_4$ SCMOS/$C_{14}$-LBM | 9 | 38 | flowable solid |
| $Na_4$ SCMOS/$C_{12}$-NMG | 10 | 34 | flowable solid |
| $Na_4$ SCMOS/Glucose | 3 | 41 | moist |
| $Na_4$ SCMOS/Sorbitol | 2 | 56 | moist |

The sugar surfactants and monosaccharides are relatively non-hygroscopic in their uptake of water. $Na_4$ SCMOS absorbs 38% water. In the presence of sugar surfactants, this builder absorbs similar amounts of water, however, the mixtures retain the free flowing nature of the pure surfactant. In the presence of only the monosaccharides which do not themselves absorb water, SCMOS still liquifies.

The above data suggests that it is possible for water to structure itself between the builder and the polar sugar head group of the surfactant while little, if any, resides between the hydrophobic long chain groups (hydrophobic-hydrophilic (HpHp) interactions). Even though the amount of water absorbed by the mixture of surfactant and builder is equivalent to that of pure builder, very little liquefaction occurs. This phenomena may be due to the combined effects of both hydrogen bonding and HpHp interactions as stated above.

A mixture of builder and monosaccharide, on the other hand, would only interact via hydrogen bonding (absence of HpHp interaction) and can, therefore, liquify on exposure to high humidity. Mixtures of different alkyl chain lengths, as for example in coco, appear to differ in HpHp, giving mixtures having a sticky feel.

EXAMPLE 2

A powdered detergent composition having the following composition is prepared.

| INGREDIENTS | % |
|---|---|
| Admixture of 1:2 tetrasodium sulfo carboxymethyloxy succinate and $C_{14}$ lactobionamide | 35 |
| Zeolite 4A | 14.0 |
| $C_{8-14}$ alkylbenzene sulfonate | 12.0 |
| Tallow alcohol sulfate | 6.0 |
| Optical brightener | 0.1 |
| Sodium carbonate | 16.0 |
| Sodium silicate 1.4 ratio $Na_2O:SiO_2$ | 2.5 |
| Enzymes | 1.4 |
| Balance Water to | 100 |

It is expected that the mixture added to the detergent will have good flow properties over a composition containing just the tetrasodium salt of ODS.

It is understood that the examples and embodiments described herein are for illustrative purposes only and that various modification or changes in the light thereof will be suggested to persons skilled in the art and are to be included within the spirit and purview of this application and the scope of the appended claims.

What is claimed is:

1. A method for improving the flowability of granular compositions containing sulfo carboxymethyloxy succinic acid (SCMOS) comprising:

preparing an intimate flowable granular admixture consisting essentially of an alkali metal salt of said SCMOS with a glycolipid surfactant selected from the group consisting of an alkyl lactobionamide having the structure set forth below;

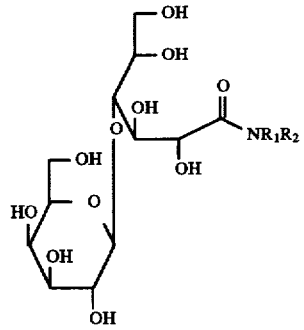

wherein $R_1$ and $R_2$ are the same or different and when different, differ by no more than 2 carbon atoms and are an aliphatic hydrocarbon radical of 8 to 18 carbon atoms;

and an alkyl N-methyl glucamide having an alkyl group of 8 to 18 carbon atoms, in a ratio of said SCMOS to said glycolipid of 1:1.4 to 1:4.

2. A method as defined in claim 1 wherein said glycolipid is selected from the group consisting of tetradecyllactobionamide, lauryl N-methyl glucamide, methyl glucoside monolaurate and mixtures thereof.

3. A composition prepared by the method of claim 1.

4. A detergent composition comprising about 0.5 to 98% of a nonglycolipid surfactant and about 2% to about 99.5% of an intimate admixture consisting essentially of an alkali metal salt of SCMOS and a glycolipid surfactant selected from the group consisting of an alkyl substituted lactobionamide having the structure set forth below:

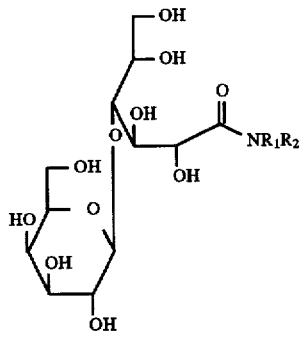

wherein $R_1$ and $R_2$ are the same or different and when different, differ by no more than 2 carbon atoms and are an aliphatic hydrocarbon radical of 8 to 18 carbon atoms;

and an alkyl N-methyl glucamide having an alkyl group of 8 to 18 carbon atoms; in a ratio of said SCMOS to said glycolipid of 1:1.4 to 1:4.

5. A composition as defined in claim 4 wherein said glycolipid is selected from the group consisting of tetradecyl lactobionamide, lauryl N-methyl glucamide, methyl glucoside monolaurate and mixtures thereof.

* * * * *